United States Patent [19]

Wheeler

[11] Patent Number: 4,633,265

[45] Date of Patent: Dec. 30, 1986

[54] LOW FREQUENCY/HIGH FREQUENCY OMNIDIRECTIONAL ANTENNA FORMED OF PLURAL DIPOLES EXTENDING FROM A COMMON CENTER

[75] Inventor: Harold A. Wheeler, Smithtown, N.Y.

[73] Assignee: Hazeltine Corporation, Commack, N.Y.

[21] Appl. No.: 686,108

[22] Filed: Dec. 24, 1984

[51] Int. Cl.[4] ..... H01Q 21/26

[52] U.S. Cl. ..... 343/797; 343/807; 455/276

[58] Field of Search ..... 343/773, 794, 796–800, 343/807, 368, 374; 455/272, 276

[56] References Cited

U.S. PATENT DOCUMENTS

| | | | |
|---|---|---|---|
| 2,420,967 | 5/1947 | Moore | 343/792 |
| 2,432,858 | 12/1947 | Brown | 343/791 |
| 2,445,336 | 7/1948 | Rauch | 343/792 |
| 2,704,811 | 3/1955 | Walters | 343/791 |
| 2,800,656 | 7/1957 | Peterson | 343/725 |
| 2,966,678 | 12/1960 | Harris | 343/809 |
| 3,518,692 | 6/1970 | Kuecken | 343/797 |
| 3,829,863 | 8/1974 | Lipsky | 343/756 |
| 4,246,655 | 1/1981 | Parker | 455/135 |
| 4,349,825 | 9/1982 | Shmitka | 343/750 |

FOREIGN PATENT DOCUMENTS 3017169 11/1980 Fed. Rep. of Germany .

*Primary Examiner*—Eli Lieberman

*Attorney, Agent, or Firm*—E. A. Onders; F. R. Agovino

[57] ABSTRACT

Two or mutually nonparallel dipoles for operation over a common frequency band. Each of the dipoles has a central feed port and an inner end connected to a junction box with conductive walls. Each feed port is connected through a junction in the box to a receiver for the common frequency band. For diversity, two receivers for the common frequency band are connected to the two feed ports. For pseudodiversity, the dipoles are connected to a common receiver and are positioned to have noncoincident phase centers separated by more than one-quarter wavelength over some part of the common frequency band.

22 Claims, 7 Drawing Figures

PATTERN OF
THREE ORTHOGONAL DIPOLES

LOW FREQUENCY/HIGH FREQUENCY OMNIDIRECTIONAL ANTENNA FORMED OF PLURAL DIPOLES EXTENDING FROM A COMMON CENTER

BACKGROUND OF THE INVENTION

1. Field of the Invention

The invention relates generally to omnidirectional radio antennas and, in particular, to an all-coverage receiving antenna having a wide frequency range which is of the order of several octaves or decades.

2. Description of the Prior Art

The combination of three orthogonal, concentric dipoles is suggested by the prior art. However, such a combination can provide omnidirectional coverage only by three receivers for diversity reception. In addition, the need for a balanced feed for such a combination requires a wideband balun which may not be readily available.

Also, when a microwave antenna is associated with a low frequency antenna, the low frequency antenna tends to shadow the microwave antenna.

SUMMARY OF THE INVENTION

It is an object of this invention to provide an omnidirectional, wideband antenna design which combines both low and high frequency elements into a single, simple structure which minimizes blockage.

It is another object of this invention to provide an all-coverage receiving antenna having spherical coverage, and sensitivity at both low and high frequencies comparable with orthogonal, coincident dipoles in the diversity mode.

It is yet another object of this invention to provide a lightweight transportable antenna structure which can be associated with a simple network.

The antenna according to the invention comprises a set of at least two mutually nonparallel dipoles for operation over a first common frequency ban. Each of the dipoles has a central feed port, a free outer end and an inner end connected to a common junction box with metallic walls. First means are provided for connecting each feed port through a junction in the box to a receiver group for the first common frequency band. To achieve diversity, each feed port may be connected to a separate receiver. To achieve pseudodiversity, the dipoles may have phase centers separated by more than one-quarter wavelength over some part of the first common frequency band and may be connected to a common receiver.

A second set of mutually nonparallel dipoles for operation over a second common frequency band may also be used to further expand the wideband coverage of the invention.

For example, the first set of dipoles may be structured for low frequency operation including a voltage responsive circuit and the second set of dipoles may be structured for high frequency operation with a power responsive circuit. Each of the dipoles of the second set also has a central feed port, a free outer end and an inner end connected to the junction box.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
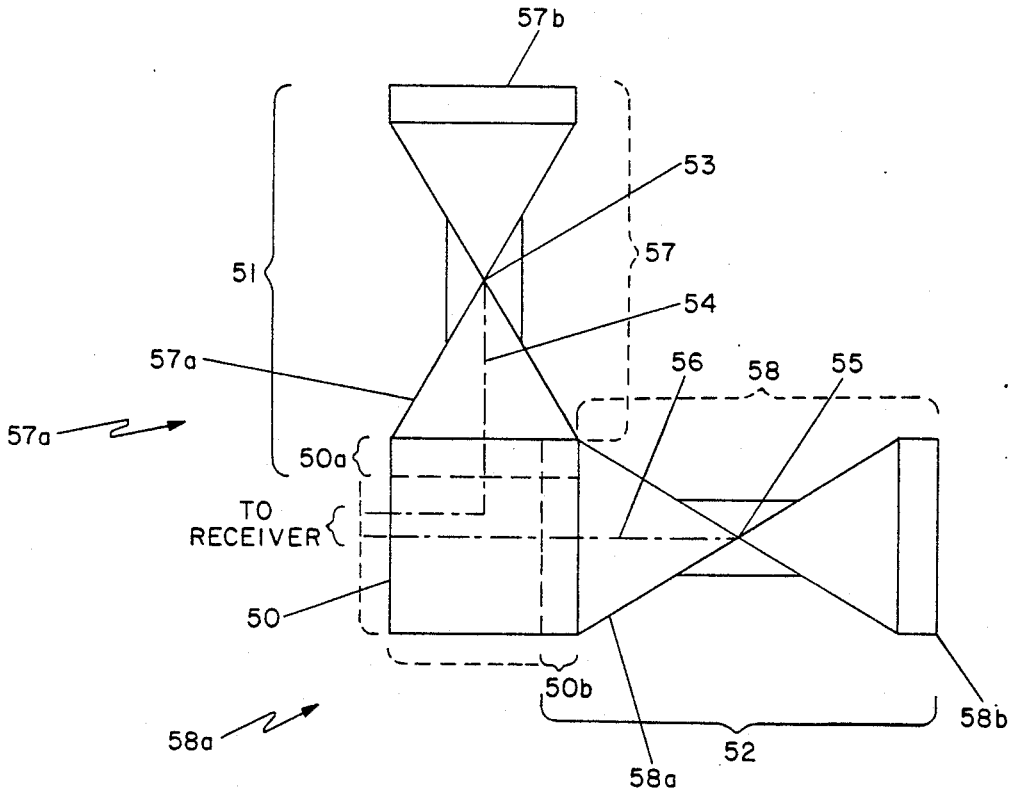
FIG. 1 is an elementary diagram of an antenna according to the invention.

FIG. 1 is an elementary diagram of an illustrative embodiment of the antenna according to the invention for providing wideband coverage in all directions. The antenna includes junction box 50 for supporting and forming a part of dipole 51 and dipole 52. Box 50 is illustrated in the form of a cube. Alternatively, box 50 may be a some other six-sided structure or other shape for supporting the dipoles and containing the junctions.

Dipoles 51 and 52 form a first set of mutually nonparellel dipoles for operation over a first common frequency band. Dipole 51 has a feed port 53 connected to line 54 and dipole 52 has a feed port 55 connected to line 56. Dipole 51 comprises a first element 57 having an inner end **57*a* and a free outer end 57*b*. Inner end 57*a* is connected to and supported by a first porition 50*a* of junction box 50. Functionally, first porition 50*a* of junction box 50 forms one end of dipole 51 and free outer end 57*b* of element 57** forms the other end.

Second element 58 has substantially the same structure as element 57 and is mounted to box 50 in a nonparallel configuration. Second element 58 has an inner end **58*a* and a free outer end 58*b*. Inner end 58*a* is connected to and supported by a second portion 50*b* of the junction box 50. Functionally, second portion 50*b* of junction box 50 forms one end of dipole 51 and free outer end 57*b* of element 57 forms the other end. One end of the second dipole 52 is the second element end 58*b* and the other end of the second dipole is the second portion 50*b*. Dipole 52 includes a second feed port 55 connected to line 56**.

First feed port 53 is connected via line 54 to a receiver. Second feed port 55 is connected via line 56 to the receiver. As a result, the antenna as illustrated in FIG. 1 receives some radiation in substantially all directions.

True spherical coverage toward all polarizations requires diversity reception in three receivers from an orthogonal set of three dipoles.

If at least two dipoles are connected to a common receiver and have phase centers separated by at least one-quarter wavelength at some frequency, there is a reduced probability of a deep null in any direction. This is here termed "pseudodiversity." If the separation is more than one wavelength, this result is improved by a multilobe pattern.

Typically, junction box 50 is a metallic cube having 6 inch dimensions and the total length of the dipoles 51 and 52 may be 48 inches with 6 inch diameters. Any necessary preamplifiers may be located in the junction box 50 and connected through long thin cables between the junction box and receivers.

An antenna according to the invention for spherical coverage could be in the form of an orthogonal set of three E dipoles whose axes intersect at the common junction box 50 for connection to unbalanced circuits. The feed ports would be near the center of each dipole. Preferably, the dipoles would have substantial width for wideband efficiency. The thin cables represented by dashed lines 54 and 56 in FIG. 1 which connect feed ports 53 and 55 to the receiver may be protected by collars (chokes) at one or both ends thereof. The collars may be made of high-mu, lossy ferrite.

In order to provide overlapping spherical coverage, three orthogonal dipoles (like the two in the generalized structure shown in FIG. 1) with three separate receivers would have outputs combined for diversity reception. A compromise in accordance with the invention is to connect the dipoles in parallel to one receiver. The receiver would still receive both linear polarization from each orthogonal direction.

In order to achieve pseudodiversity, the first and second dipoles 51 and 52 have separated phase centers. Preferably, the phase center of dipole 51 is separated from the phase center of dipole 52 by more than one-quarter wavelength at the operating frequency.

At low frequencies, the phase centers may be separated by less than one-quarter wavelength over a frequency band of operation. Then, one pair of crossed horizontal dipoles may be connected in a turnstile mode by networks for constant 90° quadrature phase difference over the band. Alternatively, such a configuration may use two receivers for diversity, one for each dipole.

At higher frequencies such that the phase centers are separated by more than one-quarter wavelength, the two or three antennas may be connected to a common receiver to provide pseudodiversity. Such pseudodiversity would provide a multilobe spherical pattern with a small probability of a deep null toward any one polarization.

A structural feature of the inventon is the integration of one end of each dipole 51, 52 with the junction box 50.

Figure 2:
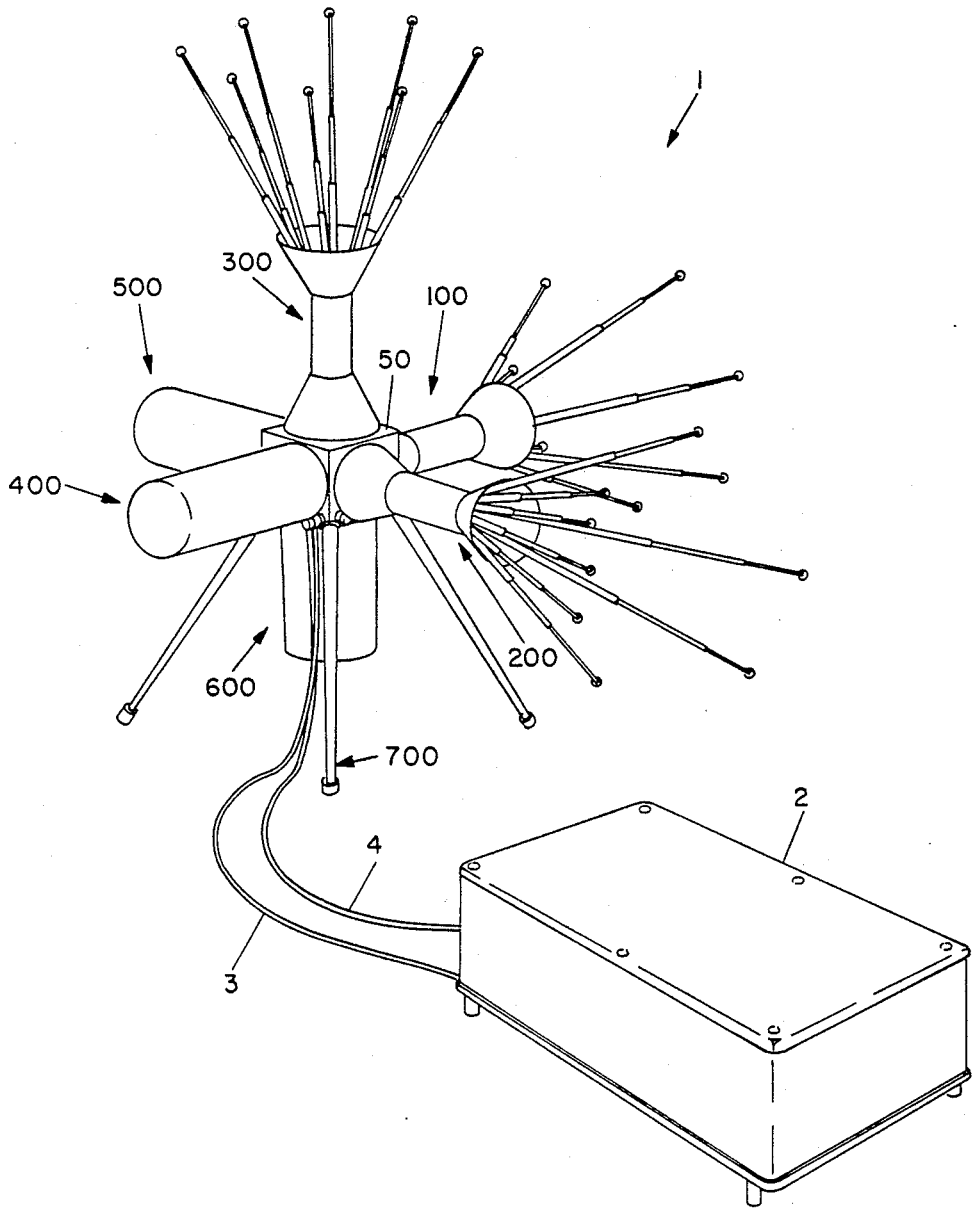
FIG. 2 is an oblique view of one embodiment of an antenna according to the invention in combination with a switching unit.

As shown in FIG. 2, one embodiment of the invention comprises radiating unit 1 and receiver group 2 interconnected by cables 3 and 4. As used herein, receiver or receiver group means one or more receivers depending on whether pseudodiversity or diversity is the objective. Radiating unit 1 comprises six dipoles, a set of three low frequency dipoles. 100, 200, 300 and a set of three high frequency dipoles 400, 500, 600.

Figure 3:
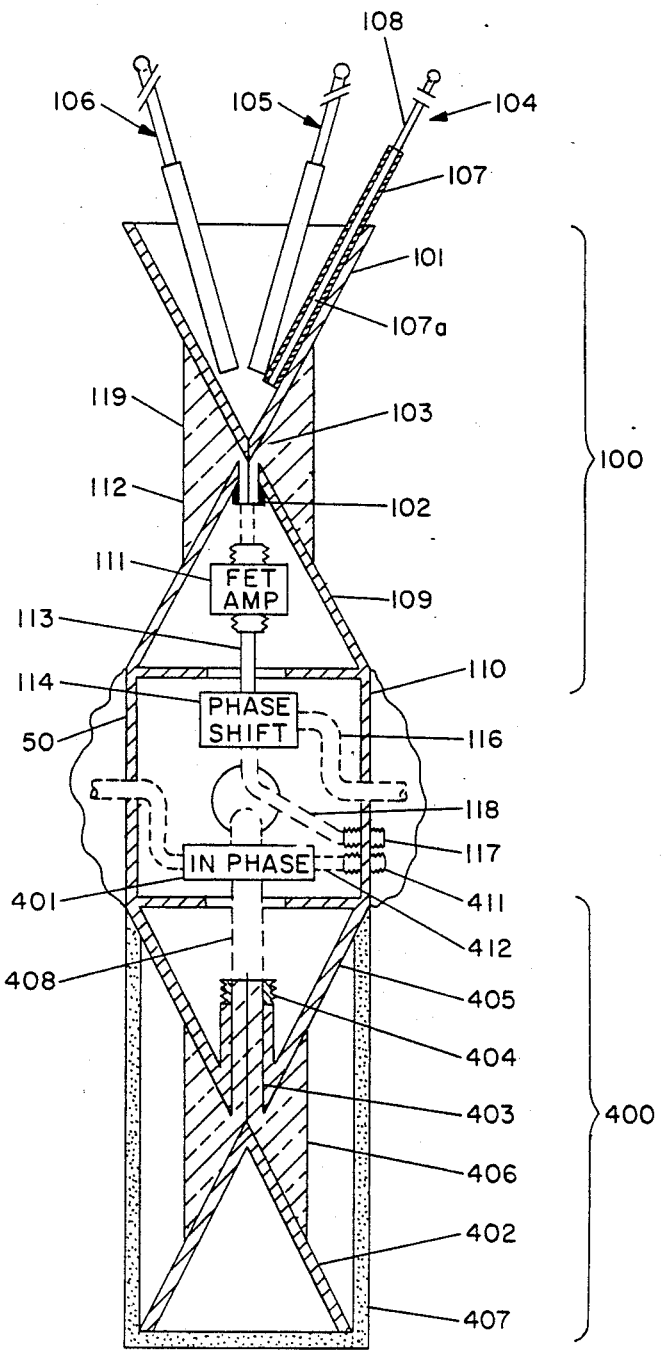
FIG. 3 is a partial, horizontal, cross-sectional view of the FIG. 2 antenna illustrating the low frequency dipole, the opposing high frequency dipole and the common junction box made in cubical shape.

Each of the low frequency radiating dipoles (100, 200, 300) is of substantially identical structure. In particular, as shown in FIG. 3, low frequency dipole 100 includes conical conducting member 101 terminating in connector 102 via connection 103. Conical member 101 is preferably of metallic construction and may support a plurality of telescoping extensions such as members 104, 105, 106 or any other structure for extending the conductive length of the dipole. Telescoping member 104 is shown in cross-section and includes lower member 107 and upper member 108 located within axial opening 107*a* in member 107. Member 107 is electrically connected to member 101 and is supported thereby.

Essentially, this embodiment is two sets of three orthogonal dipoles each associated with a common junction box. Each side of the junction box which supports a low frequency element 300 merges into conical structure 109 which supports connector 102. Conical structure 109 may be integral with or attached to cubical structure 110 which supports a dipole on each of its six sides. Located within conical structure 109 is microwave FET preamplifier 111 which is connected by conductor 112 to connector 102. The horizontal low frequency dipoles 100, 200 are connected respectively by cables 113, 116 to phase difference network 114. The output port of phase difference network 114 is connected to output connector 117 via cable 118.

Supporting the conical member 101 is cylindrical dielectric 119 which is affixed to conical member 109. Alternatively, conical member 101 may be supported by any nonconducting structure which may be affixed to conical member 109.

Low frequency dipoles 100, 200, 300 provide improved coverage by combining the horizontal pair 100, 300 of the three orthogonal elements into a wideband 90 degree phase difference network 114.

The three high frequency dipoles 400, 500, 600 are three high efficiency biconical antennas mounted on different sides of cubical junction box 110 to avoid blockage. The three elements have offset centers, and are combined in-phase, through in-phase network 401 to achieve pseudodiversity. True diversity would require combining the output power of all three elements without regard to RF phase. This would result in true omnidirectional coverage but it would require separate receivers combined for diversity. Pseudodiversity provides near spherical coverage because at least one element will always receive some signal and the sum of three has a small probability of cancellation.

Each of the high frequency antennas has a structure substantially equivalent to the structure of element 400 illustrated in FIG. 3. Outer conductive cone 402 terminates in transmission line inner conductor 403 connected to connector 404. Inner electrically-conducting cone 405 is attached to cube 110 and supports connector 404. Outer cone 402 is supported by dielectric cylinder 406 and perhaps also by optional radome 407. Connector 404 is connected via cable 408 to sum network 401.

The low frequency antennas may also be provided with a radome (not shown).

Figure 4:
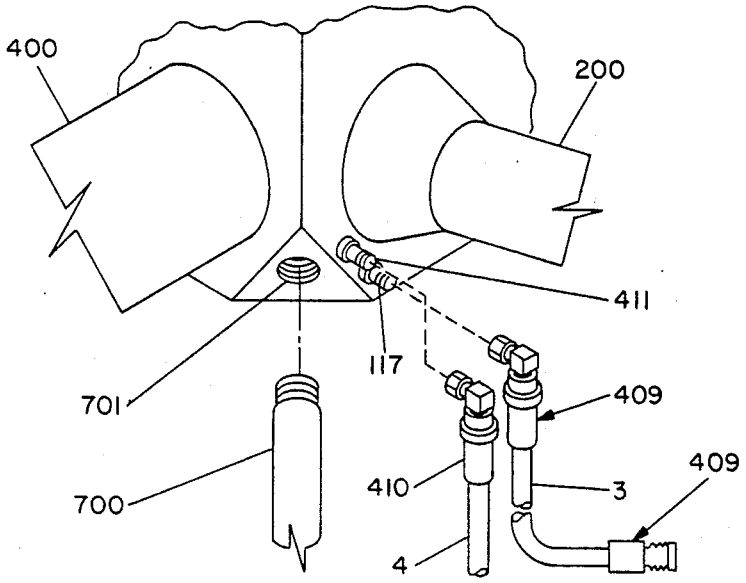
FIG. 4 is an expanded, partial view of the point of connection of the cables to the cubical junction box.

As illustrated in FIGS. 3 and 4, receiving unit 2 in FIG. 2 is connected to the low frequency dipoles via connector 117 by cable 3 which may go through a ferrite choke 409. Similarly, cable 4 which may go through a ferrite choke 410 connects to connector 411 which is connected to in-phase network 401 via cable 412. Each support leg 700 has a threaded end which engages threaded opening 701 in a truncated corner of cubical junction box 110.

The unbalanced feed for reception by the E dipoles at low frequencies is obtainable by locating an FET preamplifier inside the space between the feed port and the junction box 50 or within the box 50 itself. The thin cables 3, 4 have little effect on the thick E dipoles in view of the noncritical relations for the desired coverage. The residual effect of each cable can be reduced by the expedient of a choke as mentioned.

Figure 5:
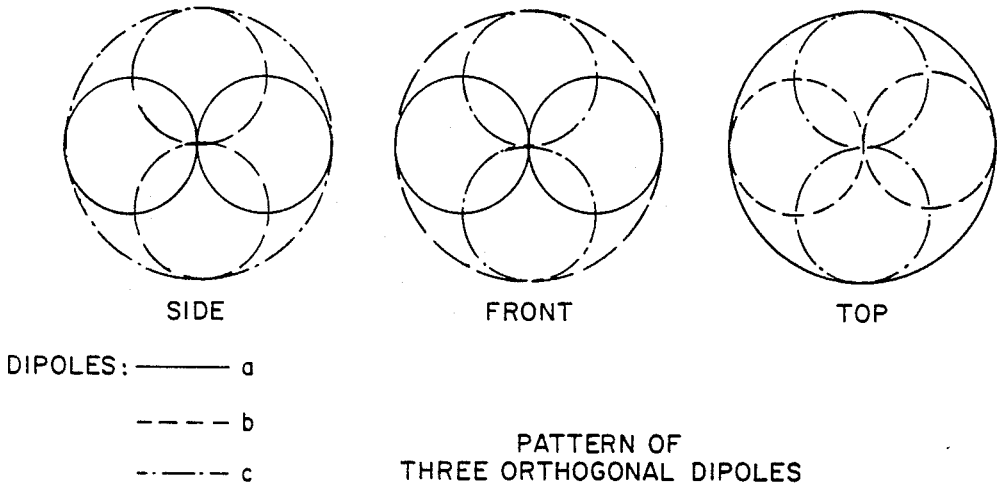
FIG. 5 illustrates the side, front and top views of the radiation pattern of three orthogonal dipoles a, b, c.

The system according to the invention results in one set of orthogonal dipoles providing nearly spherical coverage with any polarization as illustrated in FIG. 5. This is fully realized with diversity reception, and partially with pseudodiversity. It will be apparent to one skilled in the art that the radiating elements, amplifiers and power combining networks of the system according to the inventon may be segmented into any practical groups of bands. The key design features of the invention include the pattern coverage, control of the antenna pattern at all frequencies, design of a wideband low frequency antenna and the design of a wideband high frequency antenna. A set of three orthogonal, coincident dipoles fed in-phase would not provide spherical pattern coverage. They would have the pattern of one oblique dipole. The design of the invention provides an alternative which results in near-spherical coverage. Each biconical dipole of the high frequency antennas 400, 500, 600 provides a dumbell pattern and matched impedance over a wide band.

At low frequencies, a voltage responsive circuit such as a field effect transistor (FET) circuit may be used with some embodiments of the invention in order to achieve sensitivity. A small antenna connected to a voltage responsive circuit is commonly referred to as an "active" antenna. Because an "active" antenna design may not be feasible at high frequencies, the separate high frequency antennas 400, 500, 600 may be matched to cable connections to provide efficient reception. The orthogonal array of three biconicals is selected to provide near-spherical coverage by pseudodiversity or diversity.

EMBODIMENT OF THE LOW FREQUENCY ANTENNAS

The low frequency antennas 100, 200, 300 are intended to provide near spherical coverage for both vertical and horizontal polarization. The antenna and its associated amplifier may be designed to operate over a wide range of frequencies so that the antenna is very small in terms of wavelengths at the low end of the band and very large in terms of wavelengths at the high end of the band. The described invention results in a radiating design that smoothly transitions from one region to the next.

There are two modes of operation that provide near spherical coverage for different frequency ranges: quadrature phase excitations ("turnstile" antennas) and offset antenna phase centers in accordance with the invention, termed "pseudodiversity."

TURNSTILE ANTENNAS

Figure 6:
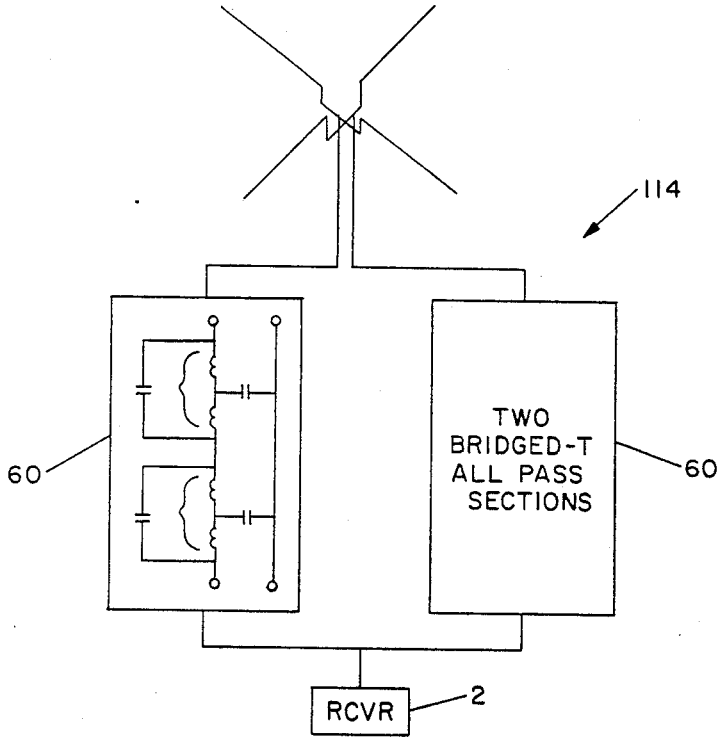
FIG. 6 illustrates the general form of a turnstile antenna which may be a component of the invention, including two wideband phase slope networks in the form of bridged-T all pass sections.
Figure 7:
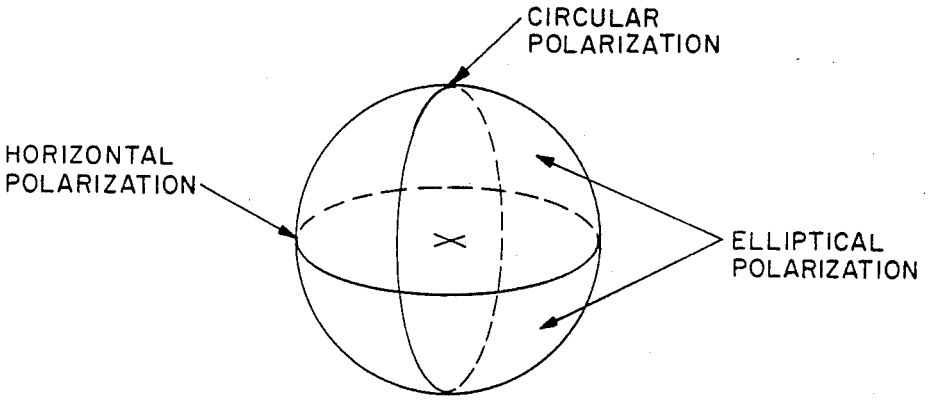
FIG. 7 illustrates the coverage of the turnstile antenna of FIG. 6.

FIG. 6 illustrates a crossed pair of horizontal dipoles, commonly called a turnstile antenna, providing coverage such as shown in FIG. 7. The pair provides hemispheric coverage, with horizontal linear polarization at the horizon.

Such a design would employ a quadrature coupler or phase difference network 114 which may operate over several decades of frequency.

A wideband quadrature phasing network is required for a wideband turnstile antenna. A lumped circuit wideband phase slope circuit is known. This design uses a pair of networks to provide a 90 degree differential phase shift. An analysis of the network is contained in a paper published by Darlington in 1950 ("Realization of a Constant Phase Difference," Bell System Technical Journal, Vol. 24, January 1950, pp. 94–104), incorporated herein by reference. A useful form of the network is shown within box 60 in FIG. 6 and is known as two bridged-T all pass sections. The signal is combined through parallel all pass phase-slope networks having coupled inductors, and delivered to a common receiver. The differential phase between the two channels is made approximately 90 degrees.

All pass sections can be implemented using lattices (balanced) as in Darlington or bridged-tees (unbalanced) as here, 60. For example, see Terman, "Radio Engineer's Handbook," McGraw-Hill, 1943, pp. 243–247, incorporated herein by reference.

Regarding the low frequency active antenna amplifier configuration, it is found that an FET amplifier connected in a source follower configuration is especially useful to drive a wideband preamplifier.

OFFSET PHASE CENTERS

Pseudodiversity according to the invention involves the use of three orthogonal dipoles with their phase centers offset. At high frequencies, the spacing between the elements will be a quarter-wave or more, and coverage similar to that discussed above will be achieved. Coverage can be nearly hemispheric, but some discrete spatial and/or polarization nulls may occur.

Pseudodiversity relies on the fact that the radiation from these spaced orthogonal dipoles is unlikely to completely cancel. If the radiation from two elements cancels, the third element may remain, thus limiting the depth of the nulls.

EMBODIMENT OF THE HIGH FREQUENCY ANTENNAS

For each high frequency antenna, a preferred embodiment is a simple biconical dipole as shown in FIGS. 1, 2, and 3. This dipole can be designed to provide a modified doughnut pattern over a decade of bandwidth. Also it can be designed to provide a good impedance match over a decade of bandwidth, for example, 2 to 20 GHz. By using three orthogonally mounted biconicals, response is obtained for both vertical and horizontal polarization, just as can be achieved for the low frequency elements.

EMBODIMENT OF LOW FREQUENCY/HIGH FREQUENCY ANTENNA

For example, one embodiment of an antenna according to the invention may be used to cover the frequency band from 100 KHz to 30 GHz. The transition frequency between the low frequency dipoles and the high frequency dipoles may be around 3 GHz. The phase difference network might be configured to function between 100 KHz and 300 MHz to provide the turnstile pattern coverage. The phase center separation between the low frequency dipoles would result in pseudodiversity pattern coverage between 300 MHz and 3 GHz. The junction box might be a 6 inch cube with metallic walls. The low frequency dipoles might be biconical structures having dimensions of 6 inches wide and 12 inches long. The high frequency dipoles might be biconicals having dimensions of 6 inches wide and 15 inches long.

While there have been described what are considered to be typical embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An antenna comprising:
(a) a first set of at least two mutually nonparallel dipoles for operation over a first common frequency band, each of the dipoles having a central feed port connected to an unbalanced feed;
(b) a junction box with conductive walls;
(c) each of the dipoles having an inner end electrically connected to the conductive walls of said box and having a free outer end; and
(d) first means for connecting each feed port through a junction in the box to a receiver for the first common frequency band.

2. The antenna of claim 1 comprising at least two receivers for the first common frequency band, each said receiver connected to one of the central feed ports, whereby diversity is achieved.

3. The antenna of claim 1 wherein said dipoles have noncoincident phase centers and are connected to a common receiver.

4. The antenna of claim 3 wherein the dipoles have phase centers separated by more than one-quarter wavelength over some part of the first common frequency band, whereby pseudodiversity is achieved.

5. The antenna of claim 1 further comprising a phase difference network located in said junction box and connected between the central feed ports of two of the dipoles and a common receiver.

6. The antenna of claim 5 wherein said network is a quadrature phase-difference network connected between the feed ports of two of the dipoles and their common receiver, whereby a turnstile mode of radiation is achieved.

7. The antenna of claim 1 wherein the set includes three mutually perpendicular dipoles.

8. The antenna of claim 7 comprising three receivers for the first common frequency band, each said receiver connected to one of the central feed ports, whereby diversity is achieved.

9. The antenna of claim 7 wherein said dipoles have noncoincident phase centers and are connected to a common receiver.

10. The antenna of claim 9 wherein the dipoles have phase centers separated by more than one-quarter wavelength over some part of the first common frequency band, whereby pseudodiversity is achieved.

11. The antenna of claim 7 wherein said junction box is a cube and each of said dipoles is supported by one side of said cube with its axis perpendicular thereto.

12. An antenna comprising:
(a) a first set of at least two mutually nonparallel dipoles for operation over a first common frequency band, each of the dipoles having a central feed port;
(b) a junction box with conductive walls;
(c) each of the dipoles having an inner end connected to said box and a free outer end;
(d) first means for connecting each feed port through a junction in the box to a receiver for the first common frequency band;
(e) a second set of at least two mutually nonparallel dipoles for operation over a second frequency band, each of the dipoles having a central feed port;
(f) each of the dipoles of said second set having an inner end connected to said box and a free outer end; and
(g) second means for connecting each feed port through a junction in the box to a receiver for the second common frequency band.

13. The antenna of claim 12 wherein the receiver for the first common frequency band comprises two receivers each connected to one of the central feed ports of the dipoles of the first set and wherein the receiver for the second common frequency band comprises two receivers each connected to one of the central feed ports of the dipoles of the second set, whereby diversity in the first and second frequency bands is achieved.

14. The antenna of claim 12 wherein said dipoles of each set have noncoincident phase centers and are connected to a common receiver.

15. The antenna of claim 14 wherein
(a) the dipoles of the first set have phase centers separated by more than one-quarter wavelength over some part of the first common frequency band; and
(b) the dipoles of the second set have phase centers separated by more than one-quarter wavelength over some part of the second common frequency band;
(c) whereby pseudodiversity is achieved.

16. The antenna of claim 12 wherein each set includes three mutually perpendicular dipoles.

17. The antenna of claim 16 comprising three receivers for each frequency band, each connected to one of the central feed ports of one of the dipoles of each set, whereby diversity is achieved.

18. The antenna of claim 16 wherein the dipoles of each set have noncoincident phase centers and are connected to a common receiver.

19. The antenna of claim 18 wherein
(a) the dipoles of the first set have phase centers separated by more than one-quarter wavelength over some part of the first common frequency band; and
(b) the dipoles of the second set have phase centers separated by more than one-quarter wavelength over some part of the second common frequency band;
(c) whereby pseudodiversity is achieved.

20. The antenna of claim 16 wherein said junction box is a cube and each of said dipoles is supported by one side of said cube with its axis perpendicular thereto.

21. The antenna of claim 1 wherein each dipole is a biconical dipole with its inner end supported by and connected to said junction box.

22. The antenna of claim 1 wherein
(a) the dipoles have a length less than one-half wavelength over some part of the first common frequency band; and
(b) each dipole is connected to a voltage-responsive circuit, whereby its effect on the radiation of the other dipoles of the first set is minimized over said part of the first common frequency band.

* * * * *